US008161783B2

(12) United States Patent
Huang et al.

(10) Patent No.: US 8,161,783 B2
(45) **Date of Patent: *Apr. 24, 2012**

(54) QUICKLY REKEYABLE LOCK CYLINDER AND PLUG ASSEMBLY THEREOF

(75) Inventors: Chao-Ming Huang, Kaohsiung County (TW); Chi-Ming Chen, Kaohsiung County (TW)

(73) Assignee: Taiwan Fu Hsing Industrial Co., Ltd., Kang Shan Town, Kaohsiung County (TW)

( * ) Notice: Subject to any disclaimer, the term of this patent is extended or adjusted under 35 U.S.C. 154(b) by 424 days.

This patent is subject to a terminal disclaimer.

(21) Appl. No.: 12/464,424

(22) Filed: May 12, 2009

(65) Prior Publication Data

US 2009/0277236 A1 Nov. 12, 2009

(30) Foreign Application Priority Data

May 12, 2008 (TW) ..... 97117486 A

(51) Int. Cl.
*E05B 27/04* (2006.01)
*E05B 29/04* (2006.01)

(52) U.S. Cl. ..... 70/492; 70/340; 70/341; 70/383; 70/384; 70/493

(58) Field of Classification Search ..... 70/337–343, 70/368, 382–385, 492–496
See application file for complete search history.

(56) References Cited

U.S. PATENT DOCUMENTS 3,002,268 A * 10/1961 Spain ..... 29/436
3,425,248 A * 2/1969 Duval ..... 70/421
3,492,843 A * 2/1970 Schieber et al. ..... 70/388
3,589,153 A * 6/1971 Hill ..... 70/384
3,667,262 A * 6/1972 Hill ..... 70/384
3,990,282 A * 11/1976 Sorum ..... 70/495
4,376,382 A * 3/1983 Raymond et al. ..... 70/338
4,472,953 A * 9/1984 Gater ..... 70/373
4,712,399 A * 12/1987 Mattossovich ..... 70/495
4,966,021 A * 10/1990 Boag ..... 70/383
6,119,495 A * 9/2000 Loreti ..... 70/340
6,776,017 B2 * 8/2004 Herdman ..... 70/338
7,007,528 B2 * 3/2006 Chong et al. ..... 70/492
7,448,239 B1 * 11/2008 Huang et al. ..... 70/360
7,448,240 B1 * 11/2008 Huang et al. ..... 70/492
7,526,935 B2 * 5/2009 Huang et al. ..... 70/360
7,584,635 B2 * 9/2009 Gan et al. ..... 70/338
7,624,606 B1 * 12/2009 Huang et al. ..... 70/338
7,628,048 B2 * 12/2009 Huang et al. ..... 70/338
7,712,344 B2 * 5/2010 Shen ..... 70/495
7,836,739 B2 * 11/2010 Huang et al. ..... 70/360
7,937,976 B2 * 5/2011 Huang et al. ..... 70/338

(Continued)

*Primary Examiner* — Lloyd Gall
(74) *Attorney, Agent, or Firm* — Muncy, Geissler, Olds & Lowe, PLLC

(57) ABSTRACT

A quickly rekeyable lock cylinder comprises a cylinder body and a plug assembly disposed within the cylinder body. The plug assembly comprises a plug body, a position block disposed at the plug body, a first rack group and a second rack group. The plug body has a longitudinal axis, a transverse axis vertical to the longitudinal axis and a rekeying tool opening. The first rack group has a plurality of first rack components. The second rack group may push the position block to move and has a plurality of second rack components in engagement with the first rack components and at least one tool-receiving portion pushed by the rekeying tool. The second rack components can move along transverse axis of the plug body to release engagement with the first rack components.

20 Claims, 13 Drawing Sheets

U.S. PATENT DOCUMENTS

| | | | | |
|---|---|---|---|---|
| 7,980,104 | B1 * | 7/2011 | Huang | 70/338 |
| 7,980,106 | B2 * | 7/2011 | Huang et al. | 70/383 |
| 2003/0084692 | A1 * | 5/2003 | Herdman | 70/338 |
| 2003/0089149 | A1 * | 5/2003 | Suzuki et al. | 70/492 |
| 2003/0154753 | A1 * | 8/2003 | Dimig et al. | 70/495 |
| 2004/0069030 | A1 * | 4/2004 | Takadama | 70/495 |
| 2006/0117822 | A1 * | 6/2006 | Boesel et al. | 70/495 |
| 2008/0264127 | A1 * | 10/2008 | Chiang et al. | 70/492 |
| 2011/0011139 | A1 * | 1/2011 | Marcelle et al. | 70/372 |
| 2011/0154872 | A1 * | 6/2011 | Huang et al. | 70/384 |

* cited by examiner

QUICKLY REKEYABLE LOCK CYLINDER AND PLUG ASSEMBLY THEREOF

FIELD OF THE INVENTION

The present invention is generally relating to a lock cylinder, more particularly to a quickly rekeyable lock cylinder and plug assembly thereof.

BACKGROUND OF THE INVENTION

Lock cylinder of known lock device typically is matched with a proper key so lock cylinder as well as key must be replaced in pair while replacing a lock, which results in high lock-replacing cost and inconvenience in use.

SUMMARY

A primary object of the present invention is to provide a quickly rekeyable lock cylinder and plug assembly thereof. The lock cylinder comprises a cylinder body and a plug assembly disposed within the cylinder body. The plug assembly comprises a plug body, a position block disposed within the plug body, a first rack group and a second rack group. The plug body has a longitudinal axis, a transverse axis vertical to the longitudinal axis and a rekeying tool opening. The first rack group has a plurality of first rack components. The second rack group may push the position block to move and has a plurality of second rack components in engagement with the first rack components and at least one tool-receiving portion pushed by the rekeying tool. The second rack components can move along transverse axis of the plug body to release engagement with the first rack components. Accordingly, the present invention may provide advantages of widely lowering rekeying cost and enhancing convenience in use, because lock replacement can be completed as soon as rekeying another matched key only without replacing lock cylinder.

DETAILED DESCRIPTION OF THE INVENTION

Figure 1:
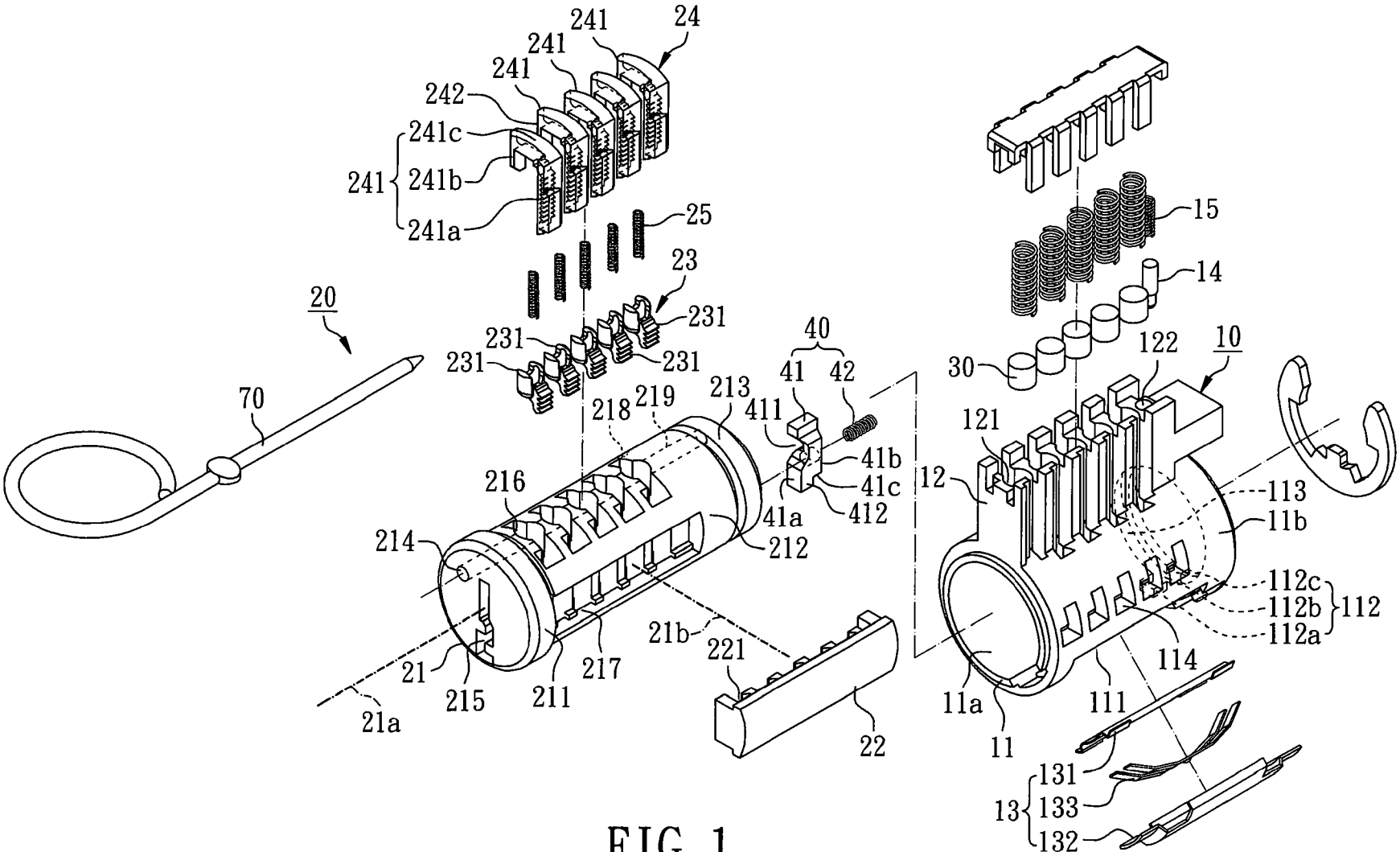
FIG. 1 is an exploded perspective view illustrating a quickly rekeyable lock cylinder in accordance with a preferred embodiment of the present invention.
Figure 2:
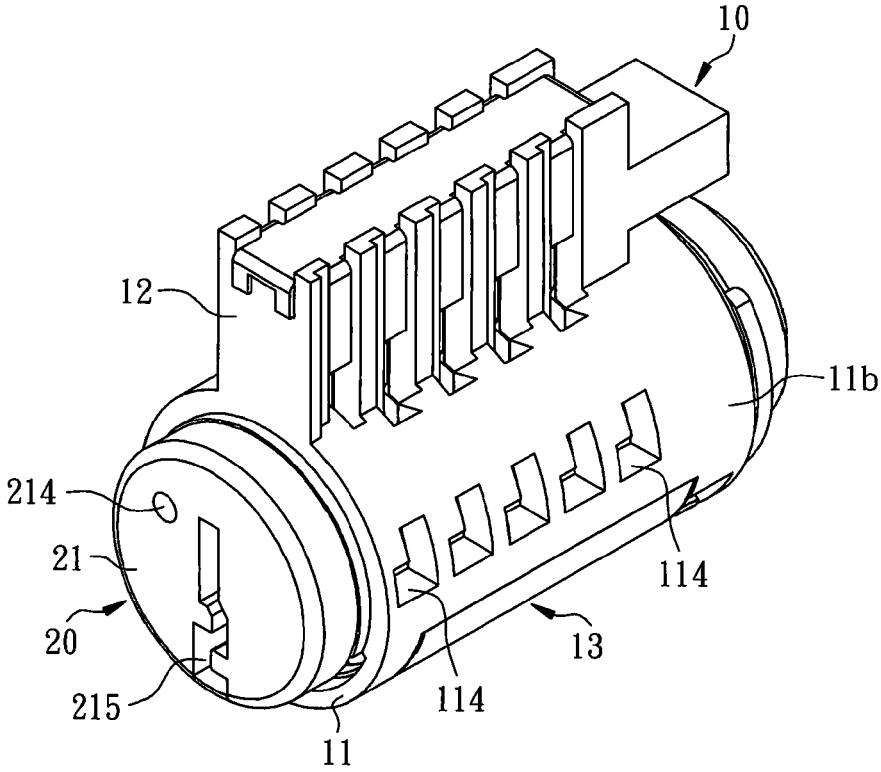
FIG. 2 is an assembly perspective view illustrating the quickly rekeyable lock cylinder in accordance with a preferred embodiment of the present invention.
Figure 3:
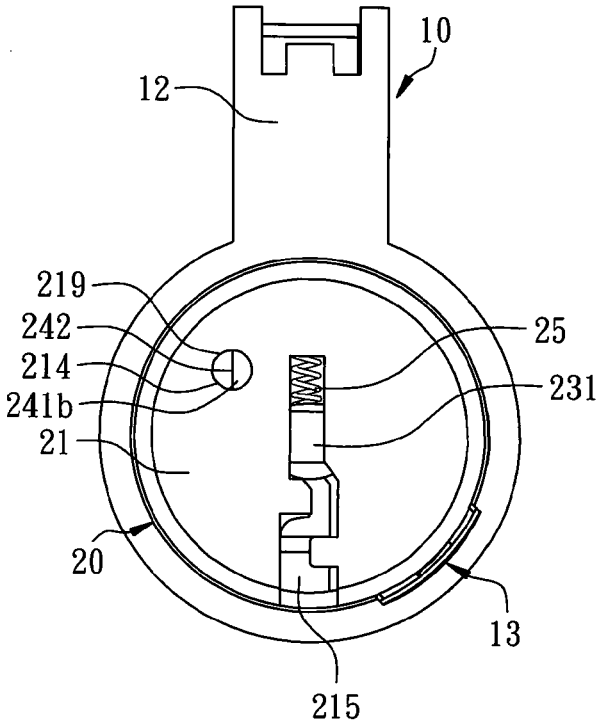
FIG. 3 is a side view illustrating the quickly rekeyable lock cylinder in accordance with a preferred embodiment of the present invention.
Figure 4:
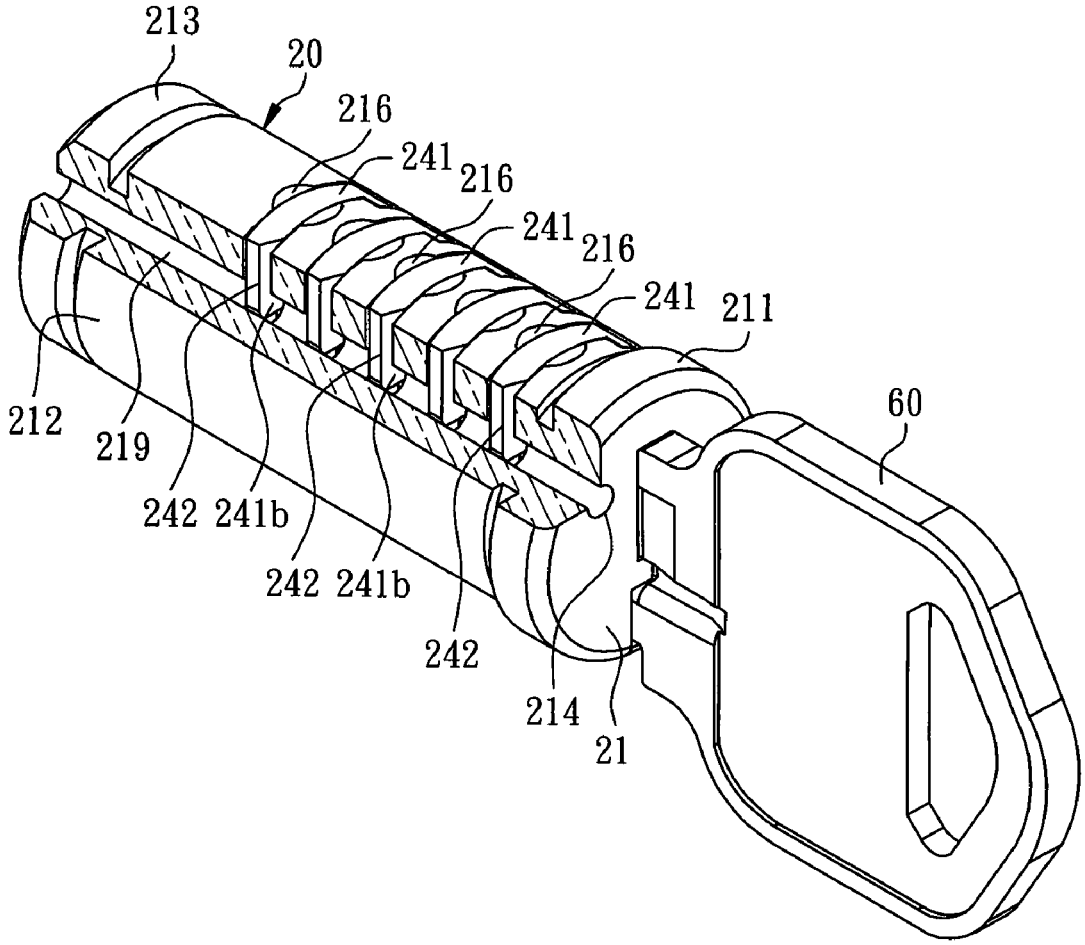
FIG. 4 is an assembly perspective view illustrating a plug assembly in accordance with a preferred embodiment of the present invention.

With reference to FIGS. 1 and 2, a quickly rekeyable lock cylinder in accordance with a preferred embodiment of the present invention comprises a cylinder body 10, a plug assembly 20 and a plurality of upper pins 30. The plug assembly 20 is disposed within the cylinder body 10 and the cylinder body 10 comprises a hollow cylinder portion 11 utilized for disposing the plug assembly 20, an extending protrusion 12 formed at one side of the hollow cylinder portion 11, a resilient assembly 13 disposed at the hollow cylinder portion 11, a location bar 14 and a first spring 15 utilized for pushing the location bar 14. In another embodiment, the cylinder body 10 may omit manufacturing the extending protrusion 12. The hollow cylinder portion 11 has an inside wall 11*a*, an outside wall 11*b*, a recession 111 recessed from the inside wall 11*a*, an axial groove 112, a radial groove 113 and an accommodating slot 114. The recession 111 communicates with the inside wall 11*a* and the outside wall 11*b*, and the radial groove 113 communicates with the axial groove 112. The axial groove 112 comprises a first limiting area 112*a*, an overlapped area 112*b* and a second limiting area 112*c*, wherein the overlapped area 112*b* is where the axial groove 112 communicates with and intersects the radial groove 113, the first limiting area 112*a* and the second limiting area 112*c* are respectively located at the two sides of the overlapping area 112*b*. The extending protrusion 12 has a plurality of upper pin holes 121 and a straight slot 122 parallel to the upper pin holes 121, the upper pin holes 121 and the straight slot 122 communicate with the hollow cylinder portion 11. With reference to FIGS. 1, 2 and 4, the resilient assembly 13 disposed at the recession 111 of the hollow cylinder portion 11 comprises a movable plate 131, an immovable plate 132 fixed at the recession 111 and at least one resilient member 133 disposed between the movable plate 131 and the immovable plate 132. In this embodiment, the movable plate 131 is transversely movable within the recession 111 and two ends of the resilient member 133 contact against the movable plate 131 and the immovable plate 132 respectively. Besides, the location bar 14 and the first spring 15 are disposed at the straight slot 122 of the extending protrusion 12.

Figure 5:
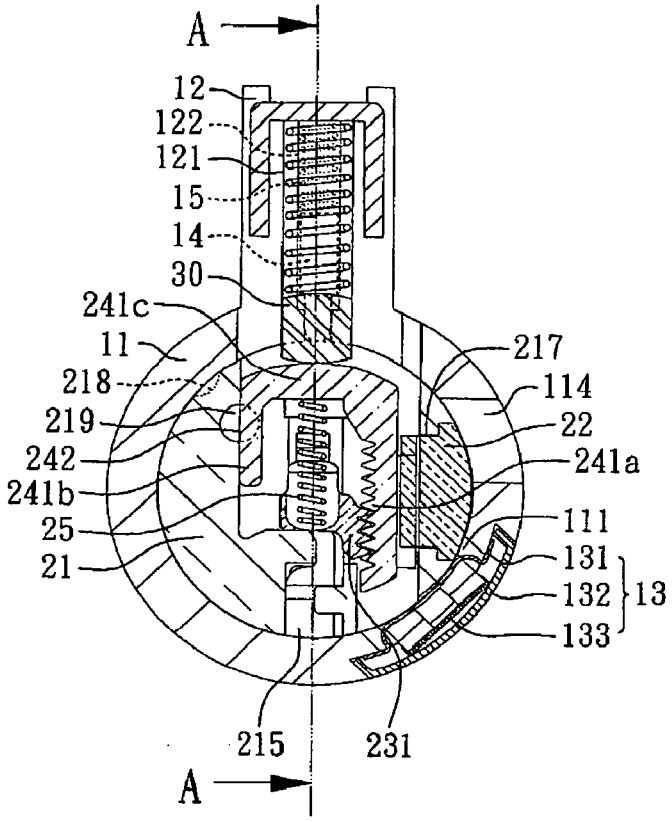
FIG. 5 is an assembled longitudinal section view illustrating the quickly rekeyable lock cylinder in accordance with a preferred embodiment of the present invention.
Figure 6:
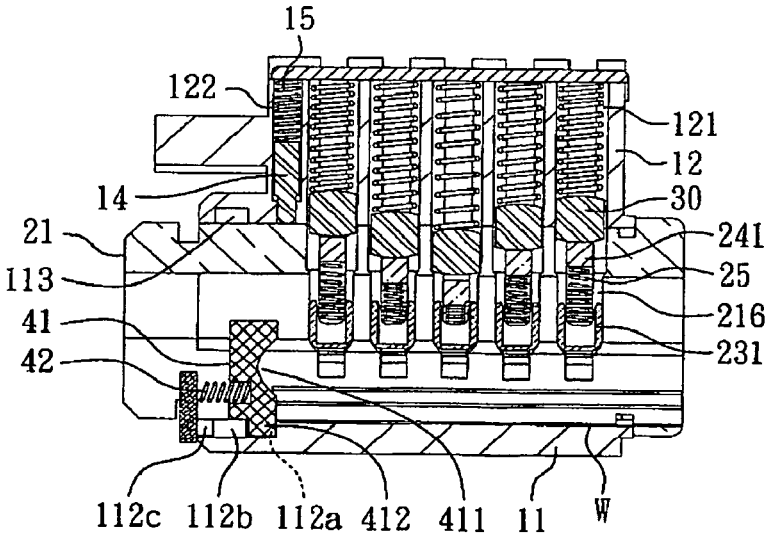
FIG. 6 is a transverse section view illustrating the quickly rekeyable lock cylinder along A-A line of FIG. 5.
Figure 22:
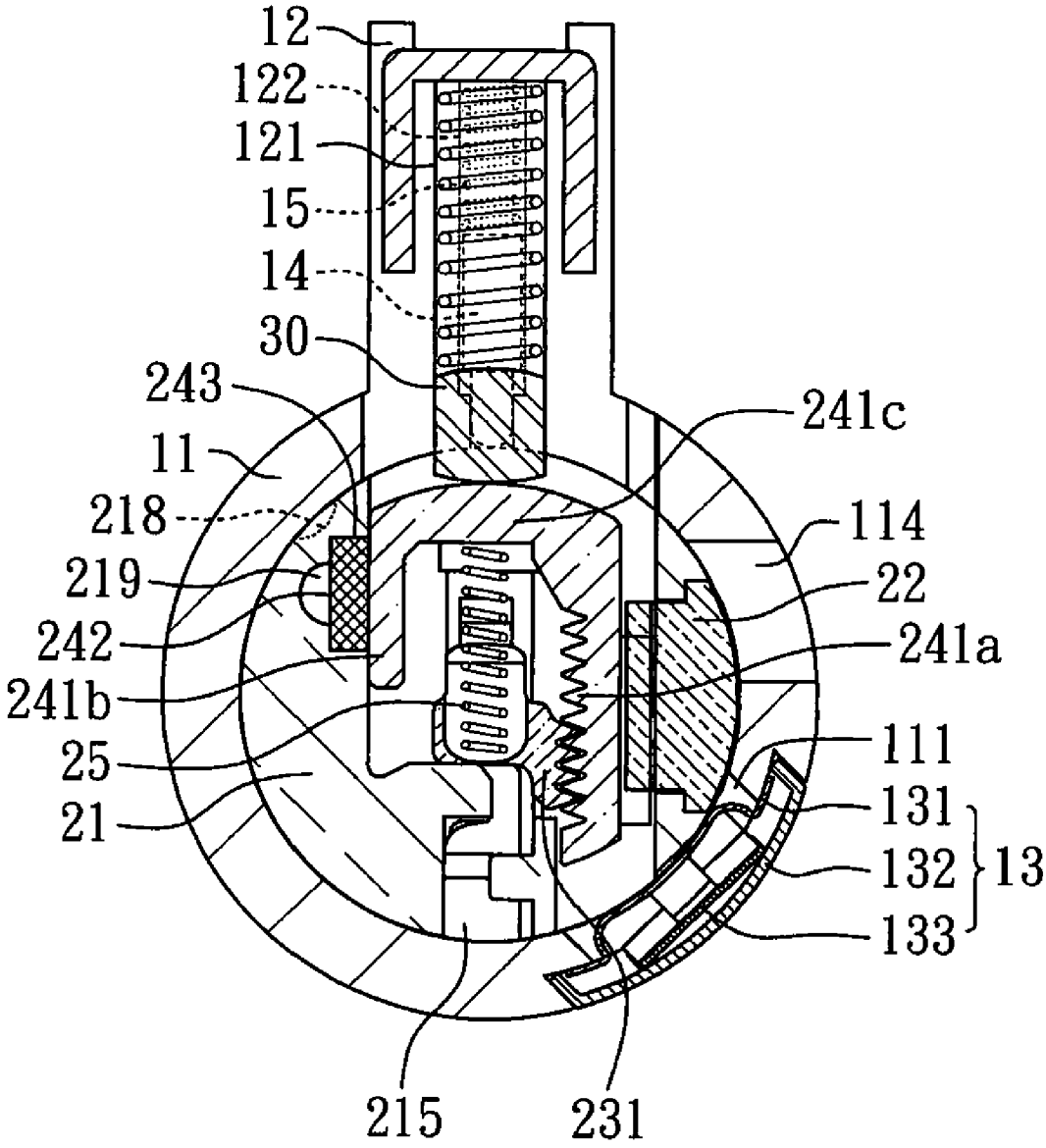
FIG. 22 is an assembled longitudinal section view illustrating a quickly rekeyable lock cylinder in accordance with another embodiment of the present invention.

With reference to FIGS. 1, 4 and 6, the plug assembly 20 comprises a plug body 21, a position block 22 disposed at the plug body 21, a first rack group 23, a second rack group 24 which is able to push the position block 22 and a plurality of elastic components 25. The plug body 21 has a longitudinal axis 21*a*, a transverse axis 21*b* vertical to the longitudinal axis 21*a*, a front portion 211, a middle portion 212, a drive portion 213, a rekeying tool opening 214 penetrating the front portion 211, a keyway W and a keyhole 215. The middle portion 212 has a plurality of pin holes 216 utilized for disposing the first and second rack assemblies 23, 24, a trench 217 in communication with the pin holes 216, a catching slot 218 and a tool-fixing hole 219 corresponding to the rekeying tool opening 214, wherein the rekeying tool opening 214 communicates with the pin holes 216. Besides, the resilient assembly 13 can be pressed in response to application of a force via the rekeying tool opening 214. With reference to FIGS. 1, 4 and 5, the position block 22, which is disposed at the trench 217 of the middle portion 212 of the plug body 21, has a plurality of pin runners 221 to dispose the second rack group 24. With reference to FIGS. 1, 3, 4, 5, 6 and 9, the first rack group 23, the second rack group 24 and the elastic components 25 are movably disposed at the pin holes of the plug body 21. The first rack group 23 has a plurality of first rack components 231 which are biased and located across the keyway W, the second rack group 24 has a plurality of second rack components 241 in engagement with the first rack components 231 and at least one tool-receiving portion 242 which can be pushed by the rekeying tool. The rekeying tool opening 214 exposes the tool-receiving portion 242 of the second rack group 24, and the tool-receiving portion 242 is preferably located at each of the second rack components 241. Besides, each of the second rack components 241 has a rack portion 241*a* in engagement with each of the first rack components 231, a contacting portion 241*b* opposite to the rack portion 241*a* and a top portion 241*c* in communication with the rack portion 241*a* and the contacting portion 241*b*. The tool-receiving portion 242 is preferably located at each of the contacting portion 241*b* of the second rack components 241, or with reference to FIG. 22, the second rack group 24 may further has a pushing bar 243 in another embodiment. The pushing bar 243 contacts against each of the contacting portions 241*b* of the second rack components 241, the tool-receiving portion 242 of the second rack group 24 may be located at the pushing bar 243 so the second rack components 241 and the position block 22 can be pushed to move by the moving pushing bar 243. With reference again to FIGS. 1, 3, 4 and 5, each of the elastic components 25 is disposed between each of the first and second rack components 231, 241 and the three components 231, 241 and 25 may form a height-adjustable assembled pin. With reference to FIGS. 1 and 6, each of the upper pins 30 is movably disposed in at least one upper pin hole 121 of the extending protrusion 12 of the cylinder body 10 and at least one pin hole 216 of the middle portion 212 of the plug body 21 and contacts against each of the top portions 241*c* of the second rack components 241.

Furthermore, with reference again to FIGS. 1 and 6, the present invention further comprises an anti-beat assembly 40 disposed at the plug body 21 in order to raise anti-burglar and security. The anti-beat assembly 40 has a limiting block 41 and a second spring 42 contacting against the limiting block 41. The limiting block 41, disposed at the keyhole 215 of the plug body 21 and adjacent to the drive portion 213, projects on the plug body 21 and corresponds to the axial groove 112 of the hollow cylinder portion 11. The limiting block 41 is movable within the axial groove 112 of the hollow cylinder portion 11 and has a first lateral 41*a*, a chamfer 411 recessed from the first lateral 41*a* and corresponding to the keyhole 215, a second lateral 41*b* opposite to the first lateral 41*a*, a bottom surface 41*c* facing the axial groove 112 and a protrusion 412 projecting on the bottom surface 41*c*. The protrusion 412 projecting on the plug body 21 is movably disposed within the axial groove 112 of the hollow cylinder portion 11 able to limit the plug body 21 not to be turned. With reference again to FIGS. 1 and 6, the second spring 42 is disposed between the drive portion 213 of the plug body 21 and the limiting block 41 and one end of the second spring 42 contacts against the second lateral 41*b* of the limiting block 41. If an unauthorized key (not shown in the drawings) is inserted into the keyhole 215 of the plug body 21 with opportune beat and turn for unlocking in a locked condition, it makes the protrusion 412 of the limiting block 41 move from the first limiting area 112*a* of the axial groove 112 to the second limiting area 112*c*. Meantime, despite the upper pin 30 or the assembled pins 22 cannot limit the plug body 21 not to be turned, but the protrusion 412 still can limit the plug body 21 not to be turned. The present invention also utilizes the limiting block 41 and the second spring 42 to strength lock cylinder structure and increases unlocking difficulty for an unauthorized key, thereby widely raising anti-burglar and security of the lock cylinder assembly structure.

Figure 7:
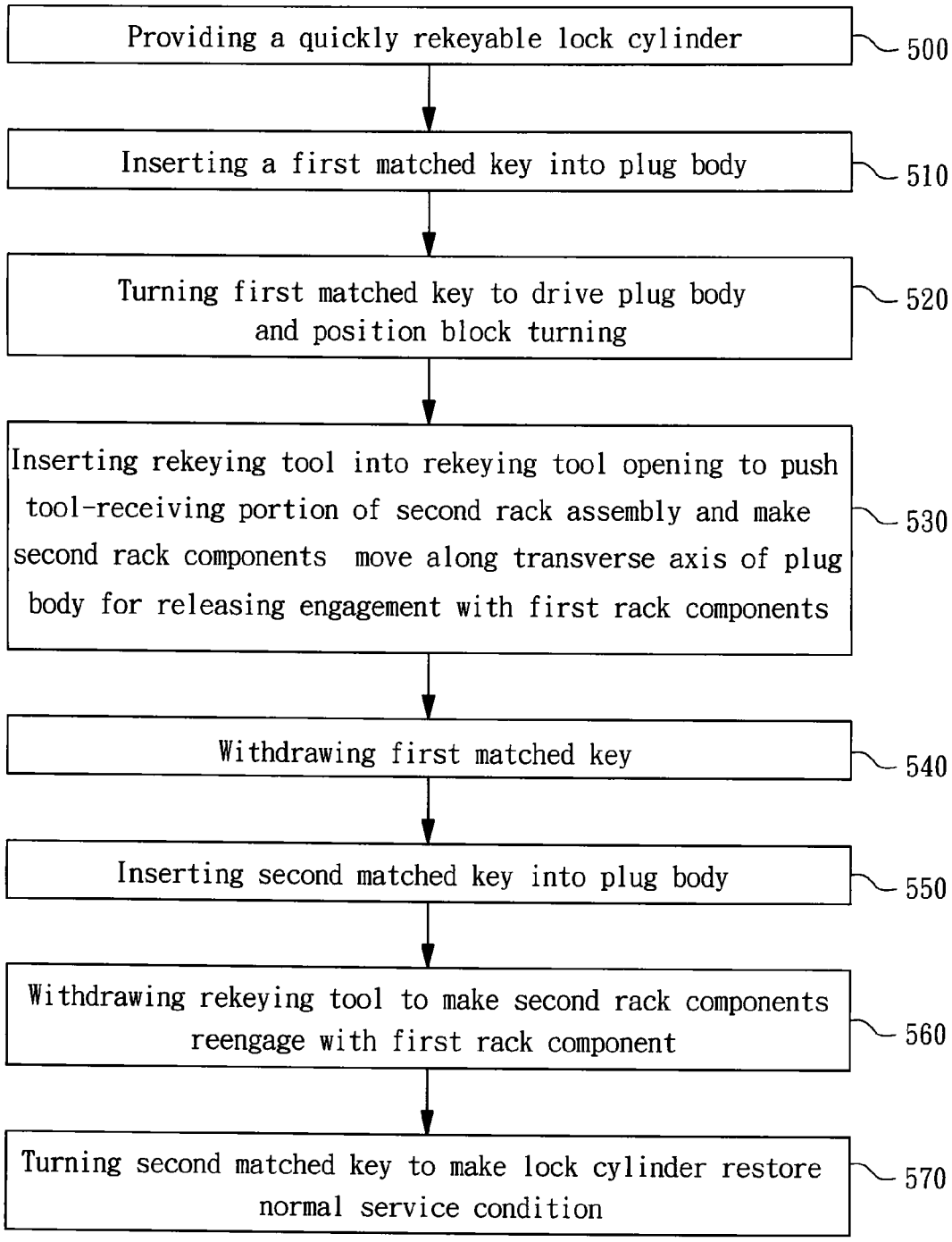
FIG. 7 is a flow chart for operating method of the quickly rekeyable lock cylinder in accordance with a preferred embodiment of the present invention.
Figure 8:
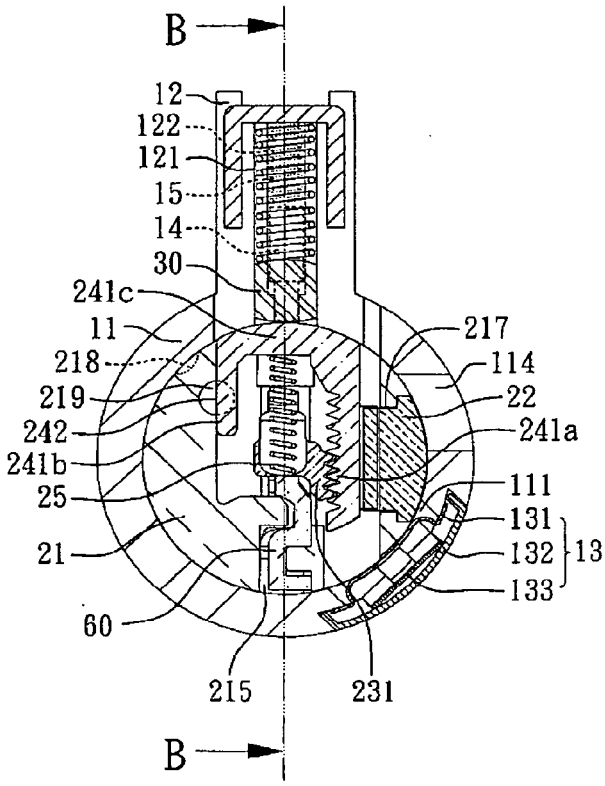
FIG. 8 is a longitudinal section view illustrating the first matched key is inserted into the quickly rekeyable lock cylinder in accordance with a preferred embodiment of the present invention.
Figure 9:
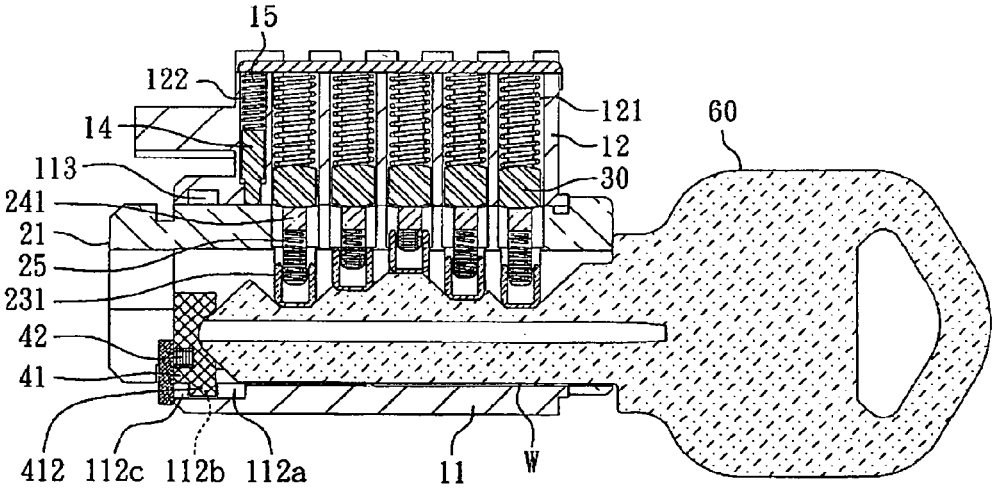
FIG. 9 is a transverse section view illustrating the first matched key is inserted into the quickly rekeyable lock cylinder along B-B line of FIG. 8.
Figure 10:
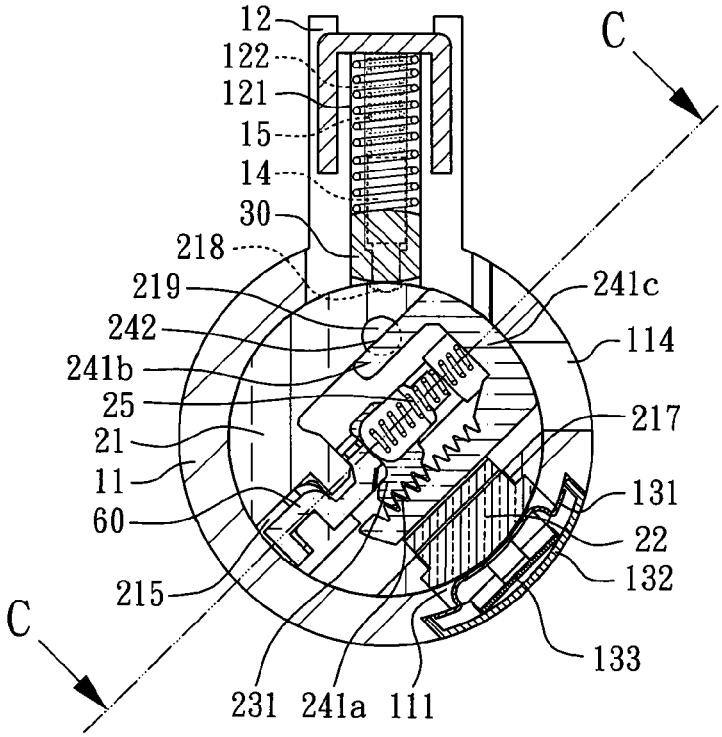
FIG. 10 is a longitudinal section view illustrating the first matched key is turned 45-degrees clockwise in accordance with a preferred embodiment of the present invention.
Figure 11:
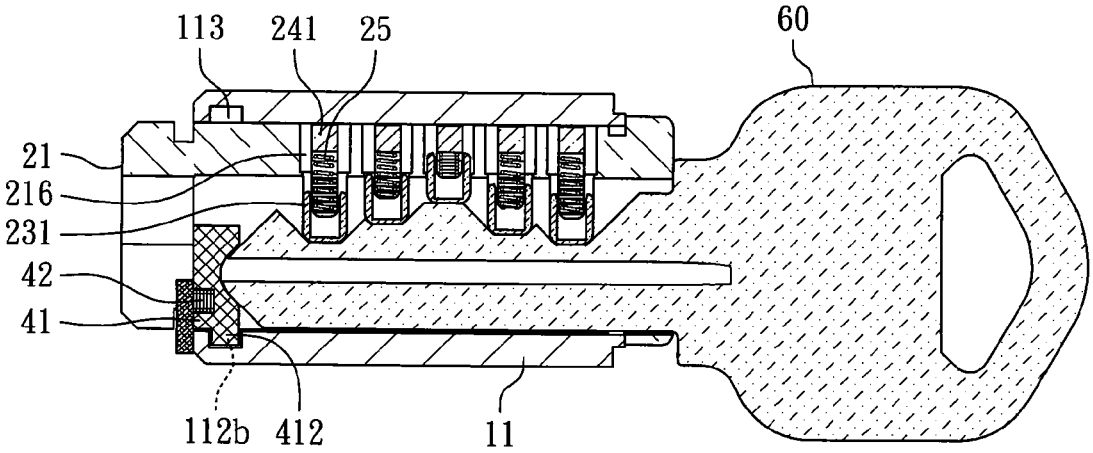
FIG. 11 is a transverse section view illustrating the first matched key is turned 45-degrees clockwise along C-C line of FIG. 10.
Figure 12:
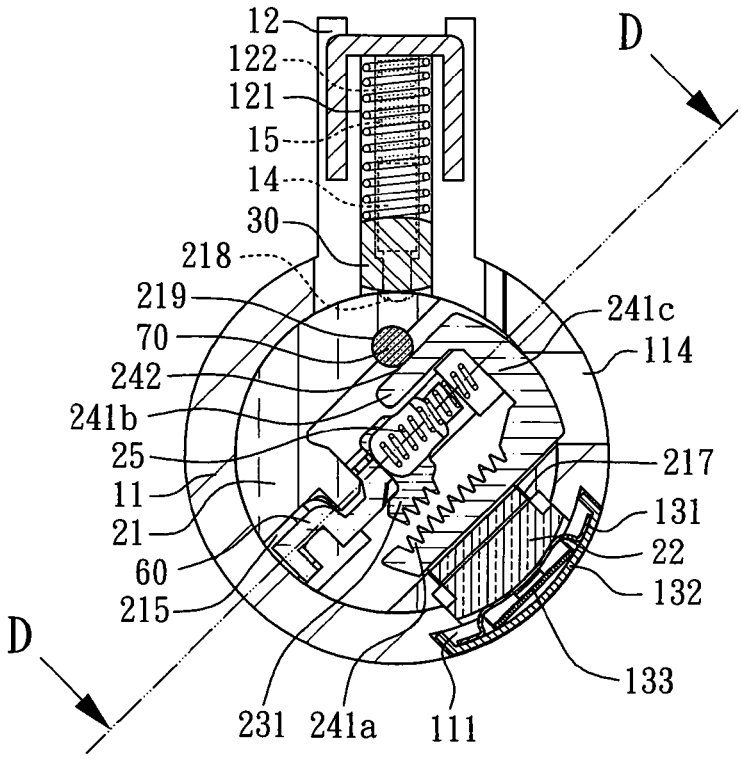
FIG. 12 is a longitudinal section view illustrating the rekeying tool is inserted into the quickly rekeyable lock cylinder in accordance with a preferred embodiment of the present invention.
Figure 13:
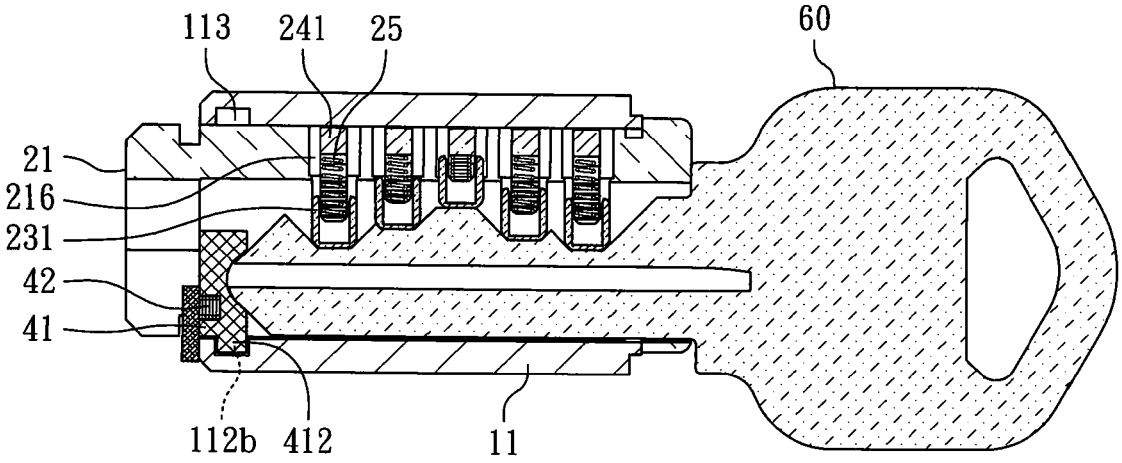
FIG. 13 is a transverse section view illustrating the rekeying tool is inserted into the quickly rekeyable lock cylinder along D-D line of FIG. 12.
Figure 14:
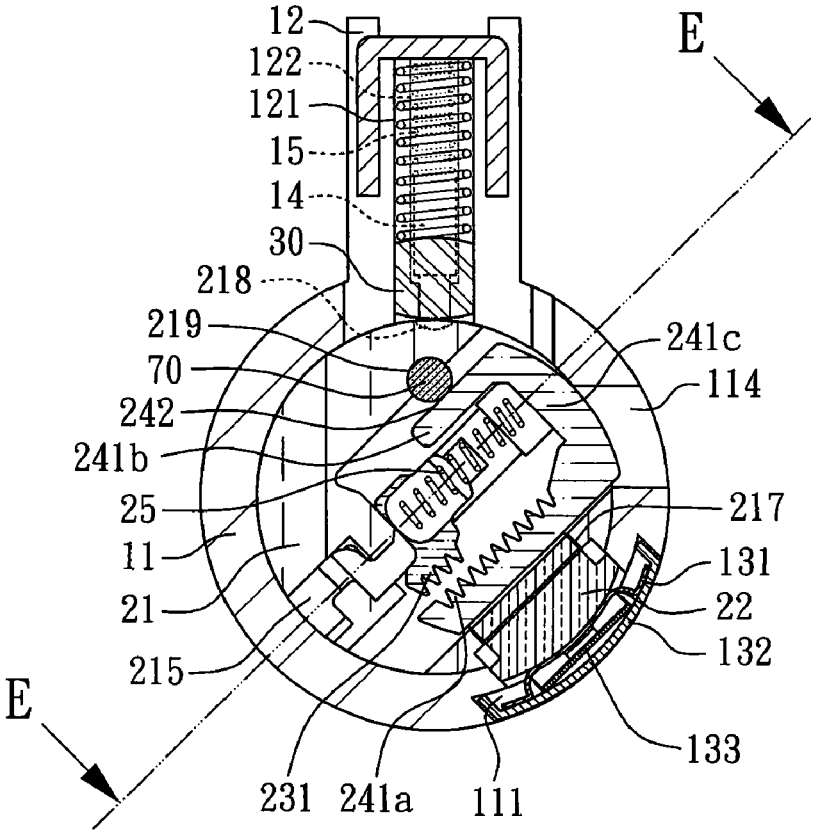
FIG. 14 is a longitudinal section view illustrating the first matched key is withdrawn in accordance with a preferred embodiment of the present invention.
Figure 15:
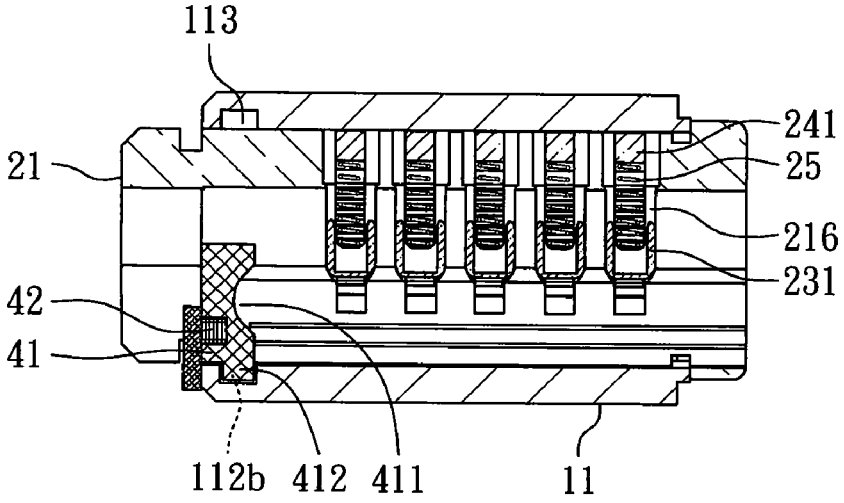
FIG. 15 is a transverse section view illustrating the first matched key is withdrawn along E-E line of FIG. 14.
Figure 16:
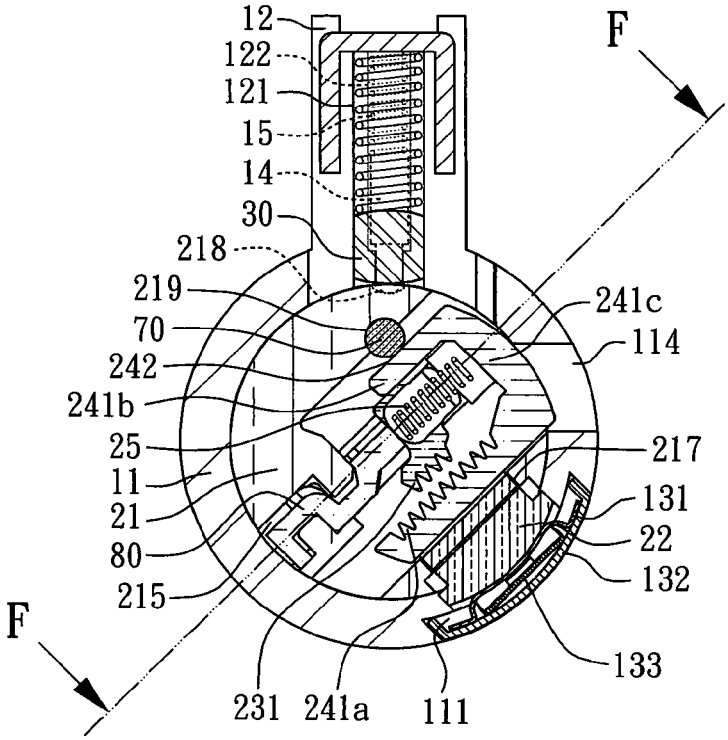
FIG. 16 is a longitudinal section view illustrating the second matched key is inserted into the quickly rekeyable lock cylinder in accordance with a preferred embodiment of the present invention.
Figure 17:
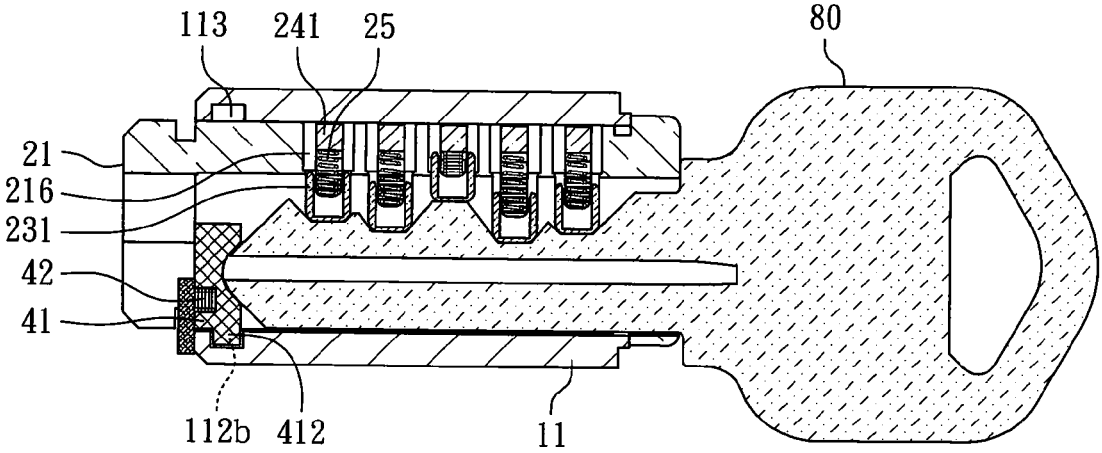
FIG. 17 is a transverse section view illustrating the second matched key is inserted into the quickly rekeyable lock cylinder along F-F line of FIG. 16.
Figure 18:
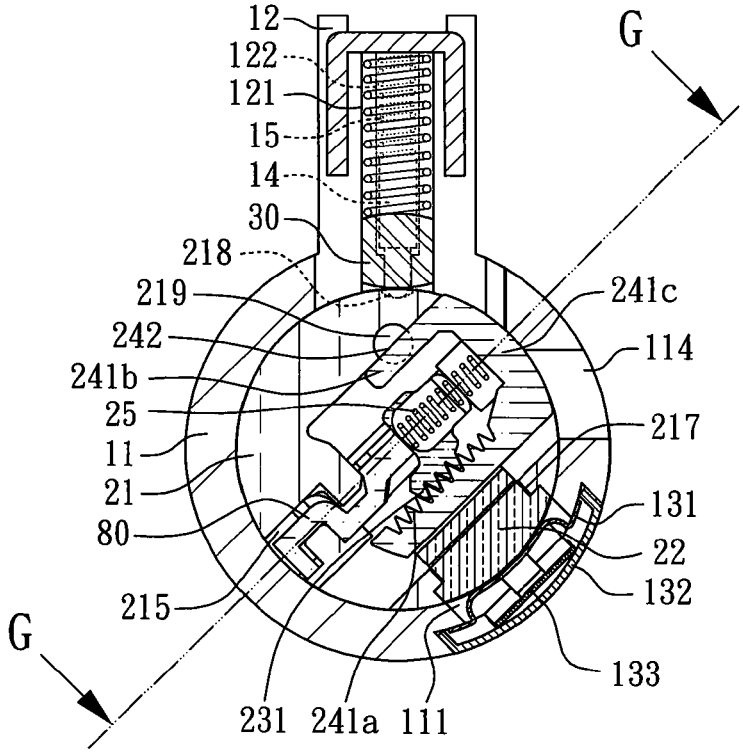
FIG. 18 is a longitudinal section view illustrating the rekeying tool is withdrawn in accordance with a preferred embodiment of the present invention.
Figure 19:
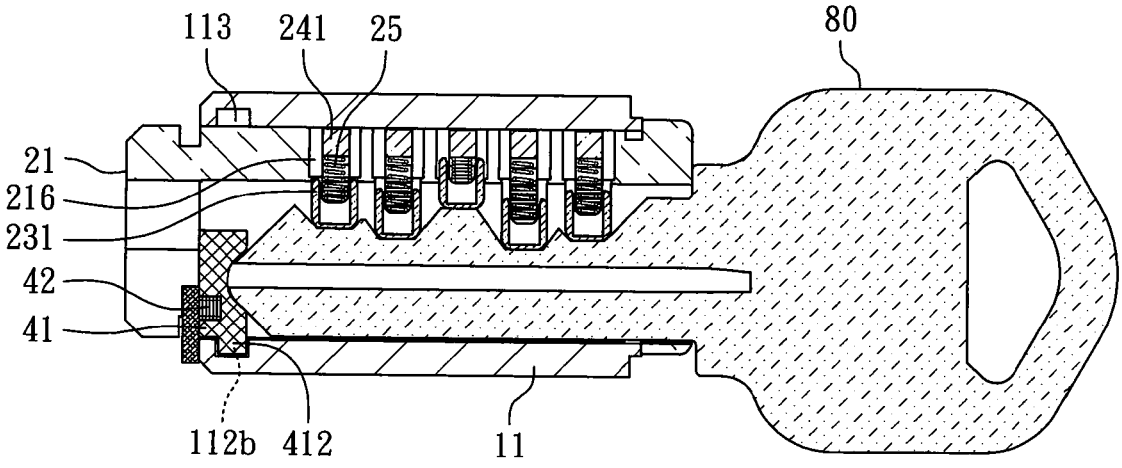
FIG. 19 is a transverse section view illustrating the rekeying tool is withdrawn along G-G line of FIG. 18.
Figure 20:
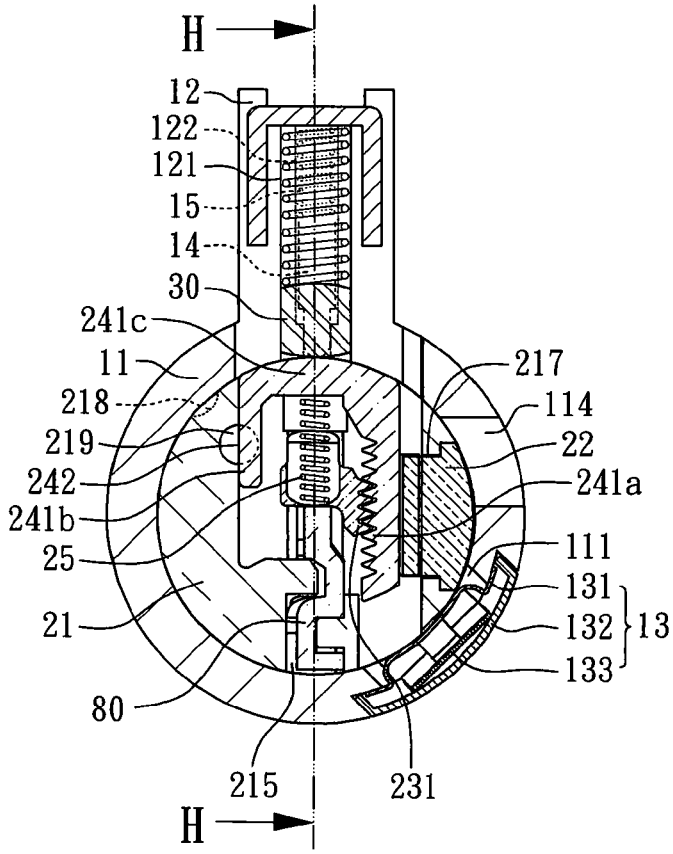
FIG. 20 is a longitudinal section view illustrating the quickly rekeyable lock cylinder in normal service condition in accordance with a preferred embodiment of the present invention.
Figure 21:
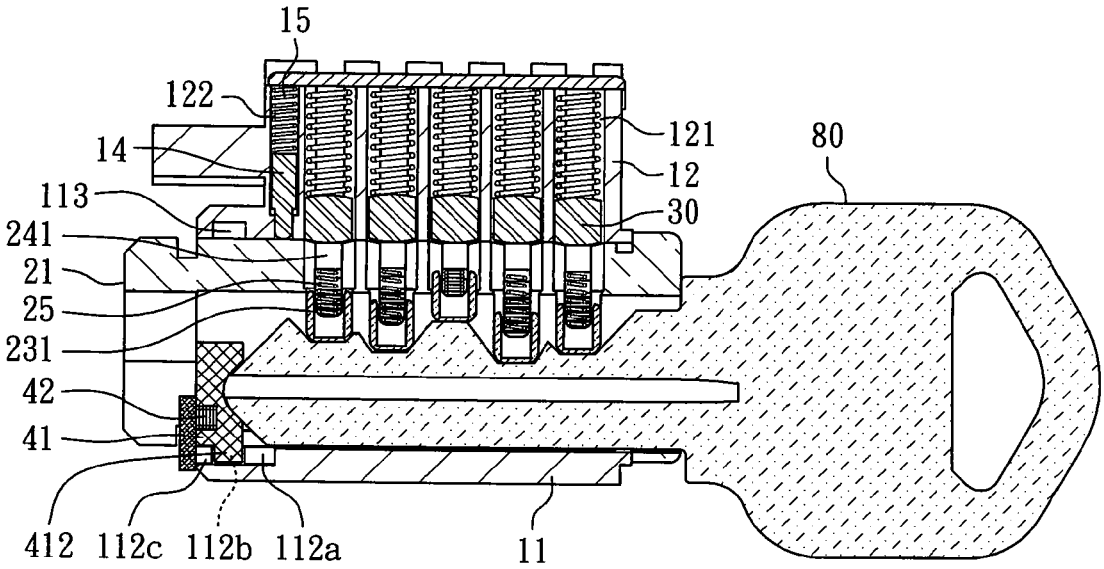
FIG. 21 is a transverse section view illustrating the quickly rekeyable lock cylinder in normal service condition along H-H line of FIG. 20.

FIG. 7 illustrates operating method of the quickly rekeyable lock cylinder comprising "providing a quickly rekeyable lock cylinder" step 500, "inserting a first matched key into plug body" step 510, "turning first matched key to drive plug body and position block turning" step 520, "inserting rekeying tool into rekeying tool opening to push tool-receiving portion of second rack group and make second rack components move along transverse axis of plug body for releasing engagement with first rack components" step 530, "withdrawing first matched key" step 540, "inserting second matched key into plug body" step 550, "withdrawing rekeying tool to make second rack components reengage with first rack components" step 560 and "turning second matched key to make lock cylinder restore normal service condition" step 570. Initially, referring to FIGS. 2, 5 and 6, "providing a quickly rekeyable lock cylinder" step 500 is proceeded, in which the quickly rekeyable lock cylinder is composed by assembling the cylinder body 10, plug assembly 20 and the upper pins 30. The rekeying tool opening 214 exposes the tool-receiving portion 242 located at least one second rack component 241 and the second rack components 241 are in engagement with the first rack components 231. Next, referring to FIGS. 7, 8 and 9, "inserting a first matched key into plug body" step 510 is proceeded, in which a first matched key 60 is inserted into the keyhole 215 of the plug body 21 and pushes the first rack components 231 to make the second rack components 241 upwardly move to rotating interface. Next, referring to FIGS. 7, 10 and 11, "turning first matched key to make plug body and position block turn" step 520 is proceeded, in which the first matched key 60 is turned to make the plug body 21 and the position block 22 turn to a predetermined angular position and the first matched key 60 is turned about 45-degrees clockwise in this embodiment. Meantime, the catching slot 218 of the middle portion 212 of the plug body 21 corresponds to the location bar 14 making the location bar 14 be caught by the catching slot 218, and the plug body 21, the position block 22, the first rack components 231 and the second rack components 241 are limited at 45-degrees position by the location bar 14. Besides, each of the top portions 241*c* of the second rack components 241 corresponds to the accommodating slot 114 of the hollow cylinder portion 11 as well as the position block 22 corresponds to the recession 111 of the hollow cylinder portion 11 and the resilient assembly 13, the position block 22 contacts against the movable plate 131 of the resilient assembly 13. Next, referring to FIGS. 1, 3, 7, 12 and 13, "inserting rekeying tool into rekeying tool opening to push tool-receiving portion of second rack group and make second rack components move along transverse axis of plug body for releasing engagement with first rack components" step 530 is proceeded, in which a rekeying tool 70 is inserted into the rekeying tool opening 214 of the plug body 21. Meantime, the rekeying tool 70 pushes the tool-receiving portion 242 of the second rack group 24 to make the position block 22 move to the resilient assembly 13. In addition, the rekeying tool 70 pushes each of the tool-receiving portion 242 located at each of the second rack components 241 to make the second rack components 241 move and pushes the position block 22 moving along the transverse axis 21*b* of the plug body 21, and the movable plate 131 of the resilient assembly 13 is pushed by the position block 22 to move to the immovable plate 132 and compresses the resilient member 133. In this embodiment, a space needed for the position block 22 to move in can be provided by that the movable plate 131 moves away. Moreover, when the position block 22 moves, the second rack components 241 will move along the transverse axis 21*b* of the plug body 21 while restraining movements in the longitudinal axis 21*a* to release engagement with the first rack components 231, wherein the accommodating slot 114 of the hollow cylinder portion 11 provides a space which is needed for each of the top portions 241*c* of the second rack components 241 to move in. In addition, the rekeying tool 70 is inserted into the tool-fixing hole 219 for fixing the second rack components 241. Next, referring to FIGS. 7, 14 and 15, "withdrawing first matched key" step 540 is proceeded, in which the first matched key 60 is withdrawn. When the first matched key 60 is withdrawn, the first rack components 231 are pushed by the elastic components 25 to fall to lowermost position. Next, referring to FIGS. 7, 16 and 17, "inserting second matched key into plug body" step 550 is proceeded, in which a second matched key 80 is inserted into the keyhole 215 of the plug body 21 and the first rack components 231 will readjust height according to different height of bitting of the second matched key 80. Next, referring to FIGS. 7, 18 and 19, "withdrawing rekeying tool to make second rack components reengage with first rack components" step 560 is proceeded, in which the rekeying tool 70 is withdrawn and meantime the position block 22 is pushed by the resilient member 133 of the resilient assembly 13 to restore and make the second rack components 241 to reengage with the first rack components 231. Finally, referring to FIGS. 7, 20 and 21, "turning second matched key to make lock cylinder restore normal service condition" step 570 is proceeded, in which the second matched key 80 is turned to make the quickly rekeyable lock cylinder restore normal service condition.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A quickly rekeyable lock cylinder comprising:

a cylinder body; and a plug assembly disposed within the cylinder body comprising:

a plug body having a longitudinal axis, a transverse axis vertical to the longitudinal axis, a keyway and a rekeying tool opening;

a first rack group disposed within the plug body having a plurality of first rack components which are biased and located across the keyway; and a second rack group disposed within the plug body having a plurality of second rack components in engagement with the first rack components and at least one tool-receiving portion, wherein the rekeying tool opening exposes the at least one tool-receiving portion of the second rack group and the second rack components are capable of being moved along the transverse axis of the plug body while being restrained against movement along a longitudinal direction of the plug body for releasing engagement with the first rack components.

2. The quickly rekeyable lock cylinder in accordance with claim 1, wherein the at least one tool-receiving portion of the second rack group is located at each of the second rack components.

3. The quickly rekeyable lock cylinder in accordance with claim 2, wherein each of the second rack components has a rack portion in engagement with each of the first rack components, a contacting portion opposite to the rack portion and a top portion in communication with the rack portion and the contacting portion.

4. The quickly rekeyable lock cylinder in accordance with claim 3, wherein the at least one tool-receiving portion is located at each of the contacting portion of the second rack components.

5. The quickly rekeyable lock cylinder in accordance with claim 1, wherein the cylinder body comprises a hollow cylinder portion utilized for disposing the plug assembly and a resilient assembly, the hollow cylinder portion has an inside wall and a recession recessed from the inside wall, the resilient assembly is disposed at the recession and pressed in response to application of a force via the rekeying tool opening.

6. The quickly rekeyable lock cylinder in accordance with claim 5, wherein the resilient assembly comprises a movable plate and at least one resilient member contacting against the movable plate.

7. The quickly rekeyable lock cylinder in accordance with claim 6, wherein the resilient assembly further comprises an immovable plate fixed at the recession of the hollow cylinder portion, the resilient member is disposed between the movable plate and the immovable plate.

8. The quickly rekeyable lock cylinder in accordance with claim 1, wherein the plug body has a front portion, a middle portion and a drive portion, the middle portion has a plurality of pin holes utilized for disposing the first rack group and the second rack group, the rekeying tool opening penetrates the front portion and communicates with the pin holes.

9. The quickly rekeyable lock cylinder in accordance with claim 8, wherein the plug assembly further comprises a position block, the middle portion of the plug body has a trench in communication with the pin holes, the position block is disposed at the trench.

10. The quickly rekeyable lock cylinder in accordance with claim 8, wherein the middle portion of the plug body has a tool-fixing hole corresponding to the rekeying tool opening.

11. The quickly rekeyable lock cylinder in accordance with claim 5, wherein the cylinder body further comprises an extending protrusion formed at one side of the hollow cylinder portion, the extending protrusion has a plurality of upper pin holes and a straight slot parallel to the upper pin holes, the upper pin holes and the straight slot communicate with the hollow cylinder portion.

12. The quickly rekeyable lock cylinder in accordance with claim 11, wherein the cylinder body further comprises a location bar and a first spring capable of pushing the location bar, the plug body has a catching slot, the location bar and the first spring are disposed within the straight slot of the extending protrusion, the location bar can be caught by the catching slot of the plug body.

13. The quickly rekeyable lock cylinder in accordance with claim 1, further comprising an anti-beat assembly disposed at the plug body.

14. The quickly rekeyable lock cylinder in accordance with claim 13, wherein the anti-beat assembly comprises a limiting block and a second spring contacting against the limiting block, the plug body has a keyhole and a drive portion, the limiting block is disposed at the keyhole of the plug body, the second spring is disposed between the limiting block and the drive portion.

15. Plug assembly of a quickly rekeyable lock cylinder comprising:

a plug body having a longitudinal axis, a transverse axis vertical to the longitudinal axis, a keyway and a rekeying tool opening;

a first rack group disposed within the plug body having a plurality of first rack components which are biased and located across the keyway; and a second rack group disposed within the plug body having a plurality of second rack components in engagement with the first rack components and at least one tool-receiving portion, wherein the rekeying tool opening exposes the at least one tool-receiving portion of the second rack group and the second rack components are capable of being moved along the transverse axis of the plug body while being restrained against movement along a longitudinal direction of the plug body for releasing engagement with the first rack components.

16. The plug assembly of the quickly rekeyable lock cylinder in accordance with claim 15, wherein the at least one tool-receiving portion of the second rack group is located at each of the second rack components.

17. The plug assembly of the quickly rekeyable lock cylinder in accordance with claim 16, wherein each of the second rack components has a rack portion in engagement with each of the first rack components, a contacting portion opposite to the rack portion and a top portion in communication with the rack portion and the contacting portion.

18. The plug assembly of the quickly rekeyable lock cylinder in accordance with claim 17, wherein the at least one tool-receiving portion is located at each of the contacting portion of the second rack components.

19. The plug assembly of the quickly rekeyable lock cylinder in accordance with claim 15, wherein the plug body has a front portion, a middle portion and a drive portion, the middle portion has a plurality of pin holes utilized for disposing the first rack group and the second rack group, the rekeying tool opening penetrates the front portion and communicates with the pin holes.

20. The plug assembly of the quickly rekeyable lock cylinder in accordance with claim 19, wherein the middle portion of the plug body has a tool-fixing hole corresponding to the rekeying tool opening.

* * * * *